US006390048B1

(12) United States Patent
Luchansky

(10) Patent No.: US 6,390,048 B1
(45) Date of Patent: May 21, 2002

(54) VALVE APPARATUS FOR INTERNAL COMBUSTION ENGINE

(76) Inventor: Kevin M. Luchansky, 80 Russell Rd., Milford, CT (US) 06460

( * ) Notice: Subject to any disclaimer, the term of this patent is extended or adjusted under 35 U.S.C. 154(b) by 0 days.

(21) Appl. No.: 09/615,288

(22) Filed: Jul. 13, 2000

(51) Int. Cl.[7] ..... F01L 7/10

(52) U.S. Cl. ..... 123/190.1; 123/190.2; 123/190.14; 123/190.17

(58) Field of Search ..... 123/190.1, 190.2, 123/190.14, 80 BB, 336, 59.1, 190.17

(56) References Cited

U.S. PATENT DOCUMENTS

| | | | | |
|---|---|---|---|---|
| 3,993,036 A | | 11/1976 | Tischler | |
| 4,036,184 A | * | 7/1977 | Guenther | 123/75 B |
| 4,163,438 A | | 8/1979 | Guenther et al. | |
| 4,421,077 A | | 12/1983 | Ruggeri | |
| 4,976,232 A | | 12/1990 | Coates | |
| 5,109,814 A | | 5/1992 | Coates | |
| 5,205,251 A | | 4/1993 | Conklin | |
| 5,392,743 A | | 2/1995 | Dokonal | |
| 5,410,996 A | | 5/1995 | Baird | |
| 5,572,967 A | | 11/1996 | Donaldson, Jr. | |
| 5,724,926 A | | 3/1998 | Wilke | |
| 5,906,180 A | | 5/1999 | Wilke | |

* cited by examiner

*Primary Examiner*—Tony M. Argenbright
*Assistant Examiner*—Katrina B. Harris
(74) *Attorney, Agent, or Firm*—Blodgett & Blodgett, P.C.

(57) ABSTRACT

A gas valve apparatus for an internal combustion engine having a combustion chamber. The gas valve apparatus includes a rotary intake valve located between an outer intake port and inner intake port at the combustion chamber and a rotary exhaust valve located between an outer exhaust and an inner exhaust port at the combustion chamber. Selectively actuatable gates are located at an outer intake and exhaust ports for controlling the opening, closing, and duration of opening of the outer intake and exhaust ports.

6 Claims, 6 Drawing Sheets

VALVE APPARATUS FOR INTERNAL COMBUSTION ENGINE

CROSS-REFERENCE TO RELATED APPLICATIONS

NOT APPLICABLE

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

This invention relates to an internal combustion engine of the piston cylinder type with one or more cylinders having rotary valves for the introduction of the fuel/air mixture into the cylinder and the evacuation of exhaust gases.

Typical internal combustion engines employ poppet type valves which require valve trains comprised of camshaft, flower, valve spring, etc. These conventional components have many well-known mechanical and thermal inefficiencies associated with them ultimately reducing engine efficiency.

A typical internal combustion engine's camshaft is designed with fixed valve opening and closing positions as well as duration of valve opening with respect to the crankshaft, thus fixing valve timing as well as valve flow characteristics. It is well known by the prior art that fixed valve timing does not take advantage of changing charge momentums which vary with engine load. Not using a full range of charge momentums greatly reduces the pumping efficiency of the engine. Therefore, the design of the present internal combustion engines is a compromise to best suit only a single optimal operating range with a certain charge momentum. Consequently, the engines efficiency decreases as the engine speed increases or decreases from that of the optimal operating range.

There are many designs of internal combustion engines utilizing rotating valves for the exchange of intake and exhaust gases which have proven superior to traditional poppet valve designs. However. many of these rotary valve designs have their own problems associated with them such as binding, sealing, and longevity issues. However, inventions have been designed to work in conjunction with cylindrical rotary valves which effectively adjust the timing and duration of the valve opening.

These issues have been solved with the use of a spherical rotary valve U.S. Pat. No. 5,361,739, shows one spherical intake drum and one spherical exhaust drum per cylinder. The cylinder head is split consisting of an upper and lower half both having a hemispherical shaped cavity which when assembled forms a complete spherical shaped cavity which houses the spherical drum valves. Both the intake and exhaust valve have a passageway which communicates with inlet or outlet ports in the cylinder head to introduce the air-fuel mixture or evacuate the exhaust, respectively. Gas tight sealing for both the intake and exhaust valves is accomplished with U.S. Pat. No. 4,976,232 disclosing an O-ring type seal which is positioned in the lower portion of the split head around the intake and exhaust ports, respectively. However, this design also has fixed valve timing.

Rotary valves have been developed to adjust the timing and duration of the valves of an engine. For example, U.S. Pat. No. 3,993,036, shows a rotary valve having a spring loaded sleeve at the trailing edge of the rotary valve. The sleeve does not allow for adjustment of the opening of the valve. Further, the sleeve may only retard the closing of the valve at high revolutions per minute (RPM) of the engine. In addition, the timing and duration cannot be controlled on command by engine load.

U.S. Pat. No. 4,163,438 shows rotary valves that may be axially displaced in a cylinder head to change the timing of the valves. However, the airflow through the valves is changed. Further, as RPM of the engine increases, it may be desirable to provide greater airflow into the combustion chamber. Furthermore, the complexity of the system may add to manufacturing costs.

U.S. Pat. No. 4,421,077 shows flappers positioned near the leading and trailing edges of an intake rotary valve. The flappers may increase the length of the port of the intake rotary valve allowing the timing of the valve to change. However, the opening of the flappers depends upon the pressure across the opening of the intake valve and the flappers will usually only open at high RPM's. Further, the timing of valves may not be controlled upon command during engine operation.

U.S. Pat. No. 5,205,251 discloses a rotary valve disposed within a rotatable sleeve. The sleeve has openings on opposing sides in order to change the timing of the valve. However, when changing the timing of the valves, only the closing of the intake valve and the opening of the exhaust valve will usually be changed.

U.S. Pat. No. 5,392,743 discloses a single rotary valve positioned on a shaft that is axially displaced by a cam to varying an open duration of the valve. Further, the complexity of the valve assembly may increase manufacturing and repair costs.

These and other difficulties experienced with the prior art rotary valve systems for internal combustion engines have been obviated by the present invention.

It is, therefore, a principal object of the present invention to provide a rotary valve system for an internal combustion engine that is adjustable for controlling the cross-sectional flow area and valve opening duration of the air intake and exhaust ports.

Another object of the invention is the provision of a rotary valve system for an internal combustion engine that is adjustable for selectively reducing the valve opening duration of the air intake and exhaust ports and for selectively making a reduction of the opening early or late in the open phase.

A further object of the invention is the provision of a spherical rotary valve assembly for use with an internal combustion engine of the piston cylinder type which can dynamically adjust the opening and closing of the intake and exhaust valves independently to meet real time changing engine loads.

It is another object of the invention to provide a rotary valve assembly for an internal combustion engine which has a quieter, more reliable operation efficiency peak in comparison to a traditional poppet valve design.

A still further object of the invention is the provision of a rotary valve assembly for an internal combustion engine which can be dynamically adjusted for the timing of the valve opening and which has fewer moving parts than previous rotary valve designs.

It is a further object of the invention to provide a rotary valve assembly for an internal combustion engine that provides higher engine performance and efficiency than previous poppet valve and rotary valve designs.

BRIEF SUMMARY OF THE INVENTION

The present invention generally comprises a spherical rotary valve having a port forming a leading edge and a trailing edge perpendicular to the axis of valve rotation which communicates with a similar port of the cylinder head. The valves are spherical and housed in a spherical shaped cavity of a split cylinder head consisting of an upper and lower half both having hemispherical shaped cavities.

The lower portion of the cylinder head comprises a single combustion chamber per cylinder. A spherical rotary valve opens or closes a passage from an induction system capable of creating the air/fuel supply which is in communication with the combustion chamber. A spherical rotary valve opens or closes a passage from an exhaust system which is in communication with the combustion chamber. The induction system is attached to the upper portion of the cylinder head such that it is free flowing into the intake port. The exhaust system is attached to the upper portion of the cylinder head such that it is free flowing out of the exhaust port.

A valve seal is housed in the lower portion of the cylinder head which surrounds the intake passageway in to the combustion chamber. A valve seal is housed in the lower portion of the cylinder head which surrounds the exhaust passageway in to the combustion chamber. The seal protrudes past the hemispherical cavity housing in order to contact a tangent line around the valve. The seal is pressed against the surface of the valve by the compression and combustion pressures with the combustion chamber. The pressure within the combustion chamber actuates the seals through passageways or pressure bleeders.

The device includes two gates, one to affect the leading edge and one to affect the trailing edge of the valve port. The movement of the gate affects cross-sectional area of the port. The gates are positioned with a sufficiently small distance between the spherical rotary valve in the upper portion of the cylinder head such that their linear motion is in the direction perpendicular to the ports path of flow. The linear motion of the gates is generally accomplished with solenoids, servos, vacuum motors, or any device capable of providing four ounces of push or pull. The actuation of the gates is generally controlled by a processor sensing engine speed, throttle position,. induction system pressure, exhaust system pressure, combustion chamber pressures, and any other such engine load variable.

According to another aspect to the invention, the distance of the gate above the valve must be sufficiently small while not contacting the spherical valve. The space now formed between the valve and gate is considered unsealed dead space. The dead space effectively chokes the flow in communication with the ports in the upper cylinder head and the ports of the spherical valve providing an effective closed valve.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF THE INVENTION

Figure 17:
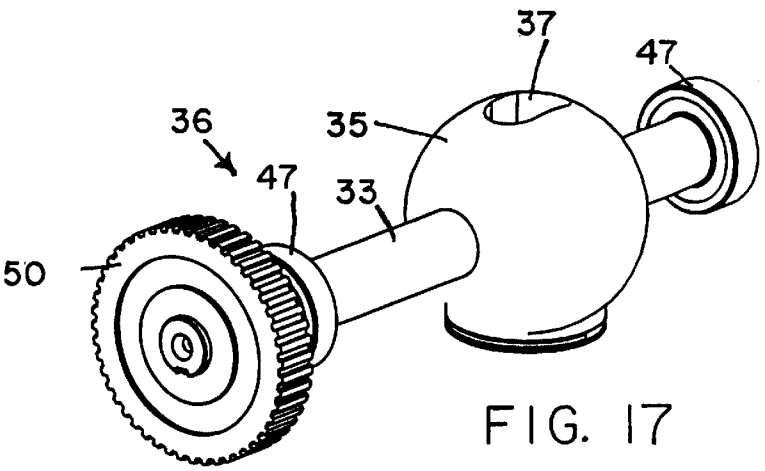
FIG. 17 is an isometric view of one of the rotary valves of the present invention.
Figure 18:
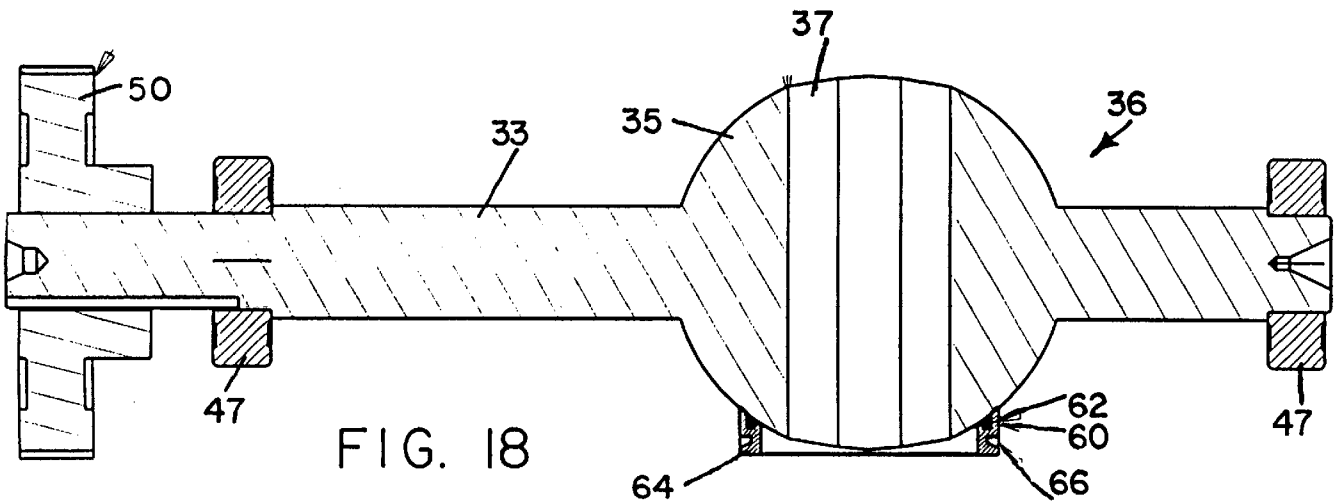
FIG. 18 is a vertical cross-sectional view of one of the rotary valves.

The spherical rotary valve cylinder head shown in FIGS. 1–5 for a single cylinder internal combustion engine which would replace the traditional poppet valve cylinder head and all associated hardware. This is a single assembly while increasing the number of assemblies will accommodate multiple cylinders. The cylinder head is generally indicated by the reference numeral 26 and comprises an upper half portion 28 and a lower half portion 30. The cylinder head of FIGS. 1–5 has an intake, generally indicated by the reference numeral 17 and an exhaust, generally indicated by the reference numeral 15. The cylinder head 26 contains two one piece spherical valves 36 and 38 having properties of low wear at temperatures of 1500° F.–200° F. as well as low rates of thermal expansion, for example, Titanium Nitrite coated steel. Valve 36 is the intake valve and is shown more fully in FIGS. 17 and 18. Each valve 36 and 38 has a shaft portion 33 and a spherical portion 35. Intake valve 36 has a bore 37. Exhaust valve 38 has a bore 39. Valves 36 and 38 are housed in cavities 40 and 42, respectively, formed in the upper half 28, see FIGS. 13–16, and cavities 40' and 42', respectively, formed in the lower half 30 of the cylinder head, see FIGS. 7–11. Referring to FIGS. 6 and 12–16, the upper half portion 28 of the cylinder head is attached to exhaust gate covers 41 and 45 which contain ports 43 and 48, respectively. The upper half portion 28 has an outer exhaust port 49 which extends from the port 43 to the cavity 40 and an outer intake port 51 which extends from the port 48 to the cavity.

Referring to FIGS. 6 and 7–11, the lower cylinder head 30 has a combustion chamber 56, an inner exhaust port 52 extending from the chamber 56 and leading to the cavity 40'. The combustion chamber 56 has passageways or pressure bleeds 58. A valve seal assembly 60 is located at each of the cavities 40' and 42'. (The valves may be liquid cooled with the addition of liquid carrying cavities, not shown, which would allow liquid to enter from one end of the valve and exit from the other end of the valve. The liquid would be introduced through passages in the cylinder head, not shown) and would be sealed from the running fluids of the engine.) Each of the valves 36 and 38 is mounted on bearings 47, see FIGS. 17 and 18, and generally rotate parallel with the crankshaft at a rate of one fourth the engines crankshaft rotational speed and are driven by gears 50 and 53, respectively, and operatively connected to the engine's crankshaft. There is suitable clearance to prohibit interference between all surfaces of the valve and the cylinder head which may be maintained with the use of ceramic coating on the hemispherical cavities of the cylinder head. The bearings are located in bearing journals 54 in the upper and lower half portions 28 and 30, respectively, of the cylinder head 26, see FIGS. 7–16.

The valve controls the working fluid of the engine by means of rotation. Therefore, during the intake portion of the cycle the bore 37 of the valve 36 is aligned with the outer intake port 51 and the inner intake port 55 and combustion chamber 56. During the exhaust portion of the cycle, the bore 39 of the valve 38 is aligned with the outer exhaust port 49 and the inner exhaust port 52 and combustion chamber 56.

During the compression and combustion portions of the cycle, the valve must seal. This is done with the valve seal assembly 60. The valve seal assembly 60 uses high pressure gases from the combustion chamber 56 to force a seal insert 62 into the valve thus sealing the valve. The insert is made from silicon carbide, tungsten carbine, or carbon graphite or any other high temperature self lubricating compound into the valve. The pressure is bled off the combustion chamber 56 through the passages or the pressure bleeds 58, which pushes on seal holder 64. the high pressure gas is prevented from passing outside of the seal holder 64 by the ring seal 66.

Figure 1:
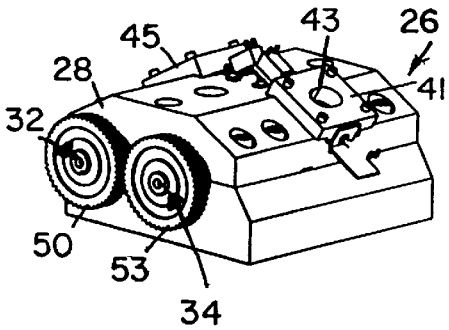
FIG. 1 is an isometric view of a cylinder head containing the rotary valve assembly of the present invention.
Figure 2:
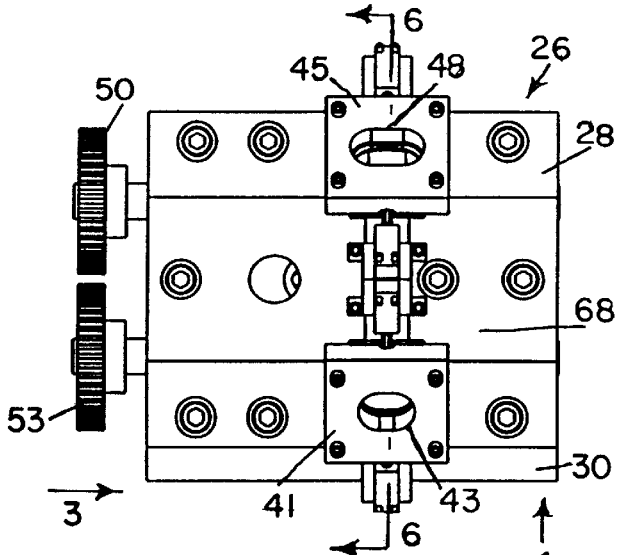
FIG. 2 is a top plan view of the cylinder head.
Figure 3:
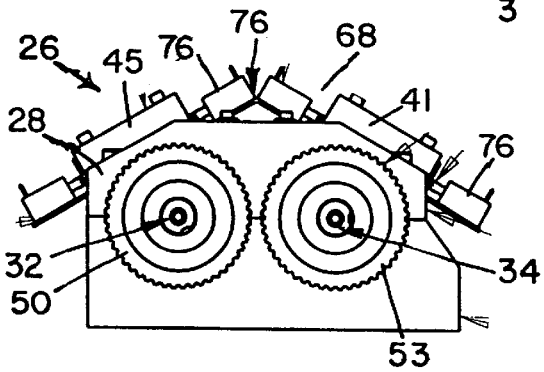
FIG. 3 is a side elevational view of the cylinder head, looking in the direction of arrow 3 of FIG. 2.
Figure 4:
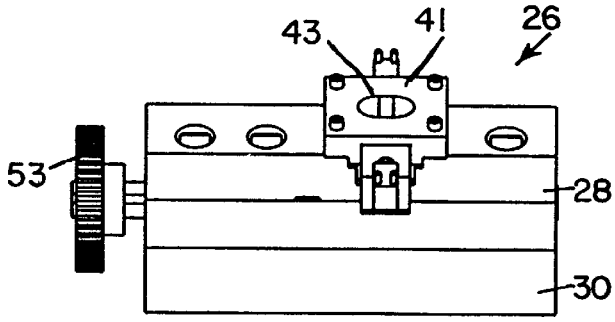
FIG. 4 is a front elevational view of the cylinder head, looking in the direction of arrow 4 of FIG. 1.
Figure 5:
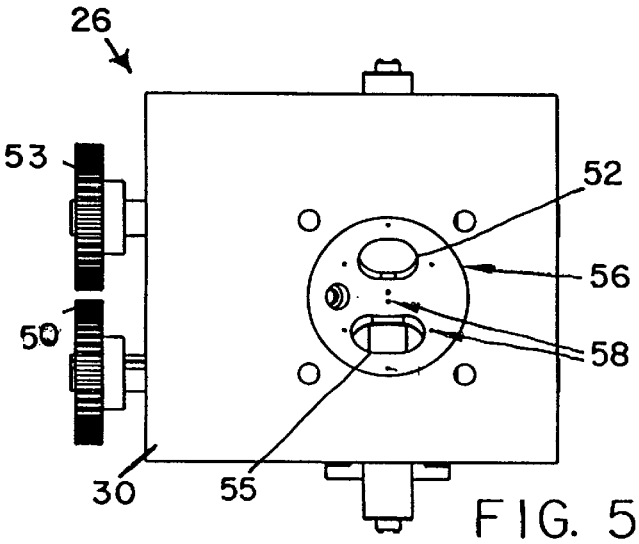
FIG. 5 is a bottom plan view of the cylinder head.
Figure 6:
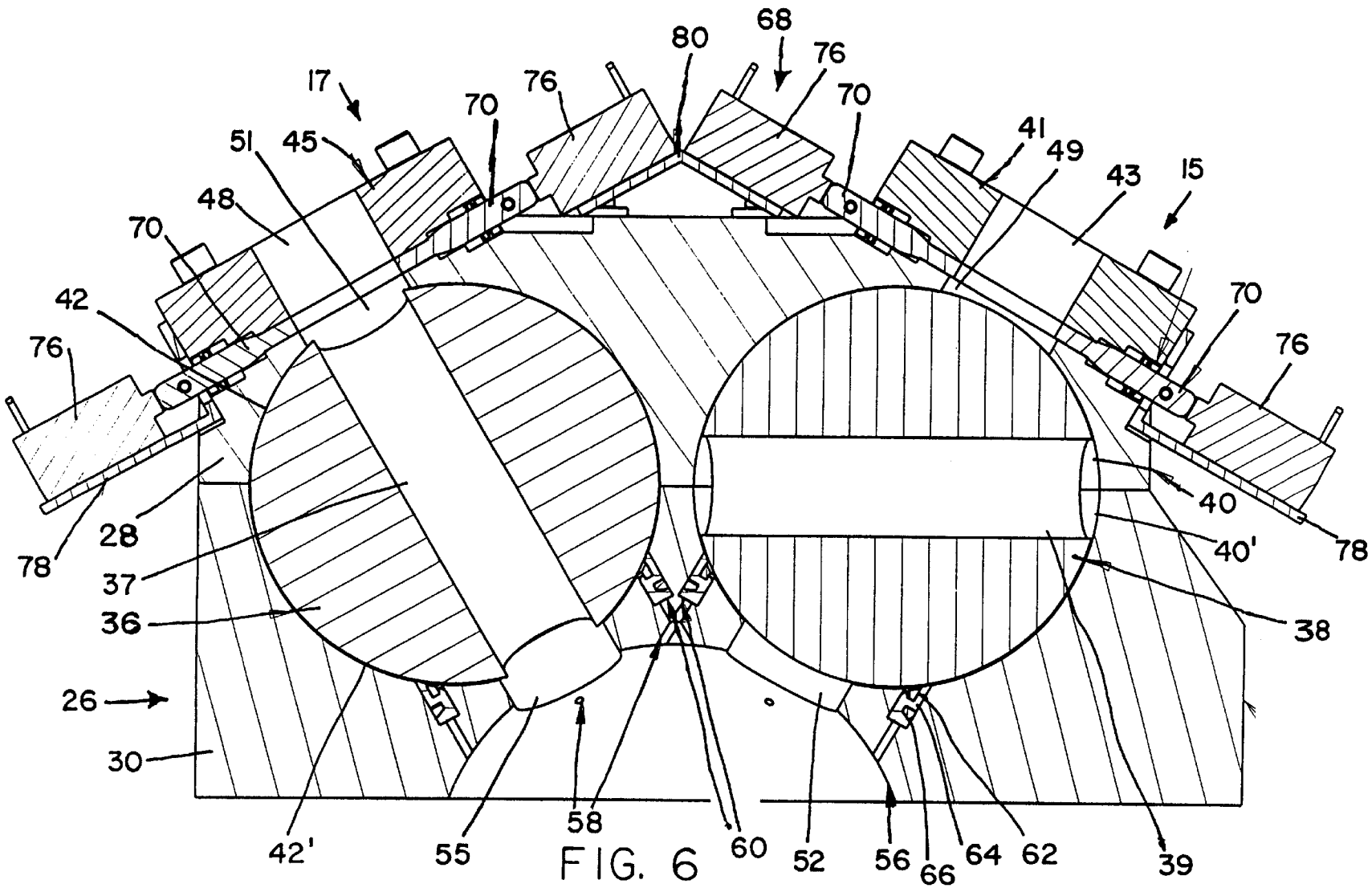
FIG. 6 is a vertical cross-sectional view taken along the lines 6—6 of FIG. 2 and looking in the direction of the arrows.
Figure 7:
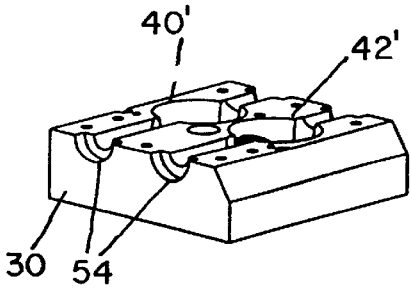
FIG. 7 is an isometric view of the bottom half portion of the cylinder head.
Figure 8:
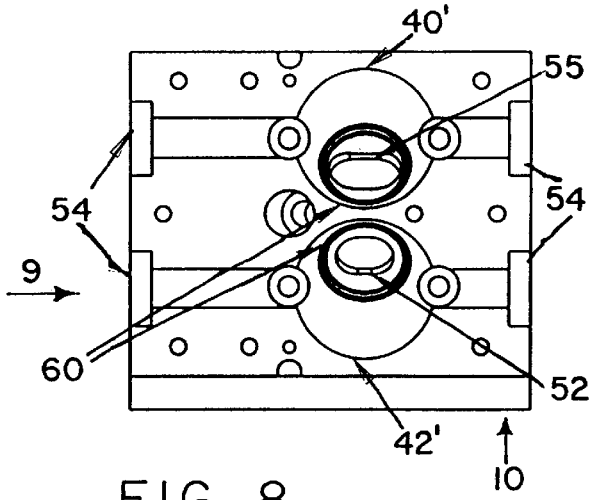
FIG. 8 is a top plan view of the bottom half portion of the cylinder head.
Figure 9:
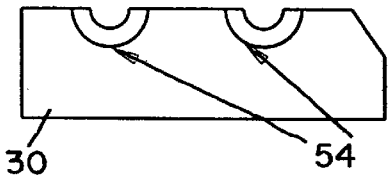
FIG. 9 is a side elevational view of the bottom half portion of the cylinder head looking in the direction of arrow 9 of FIG. 8.
Figure 10:
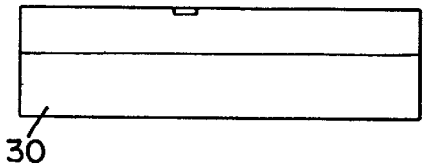
FIG. 10 is a front elevational view of the bottom half portion of the cylinder head, looking in the direction of arrow 10 of FIG. 8.
Figure 11:
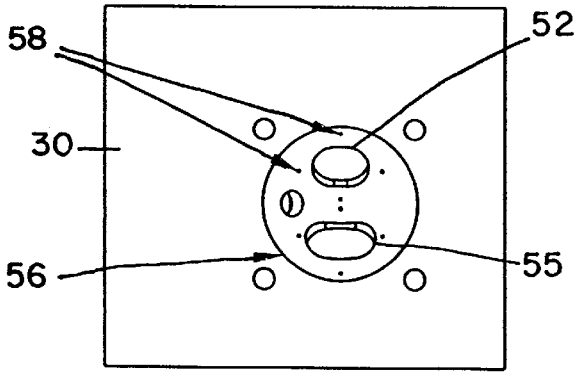
FIG. 11 is a bottom plan view of the bottom half portion of the cylinder head.
Figure 12:
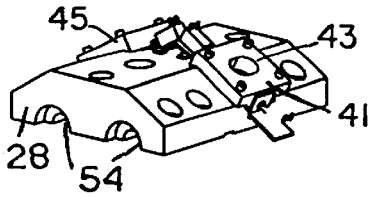
FIG. 12 is an isometric view of the upper half portion of the cylinder head.
Figure 13:
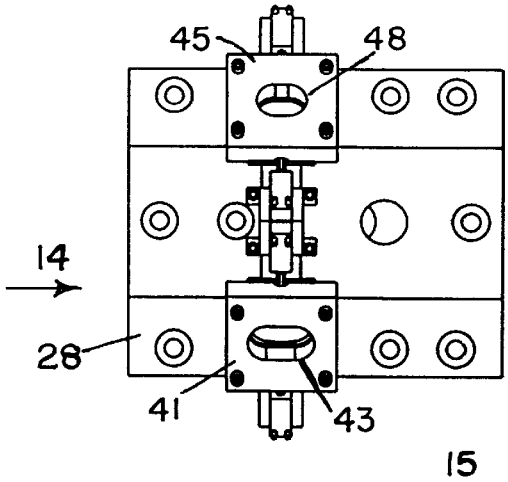
FIG. 13 is a top plan view of the upper half portion of the cylinder head.
Figure 14:
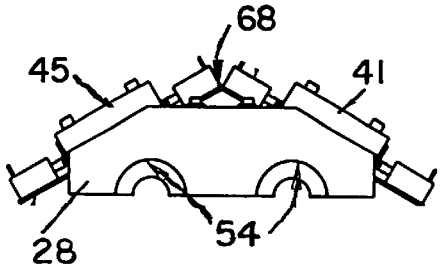
FIG. 14 is a side elevational view of the upper half portion of the cylinder head, looking in the direction of arrow 14 of FIG. 13.
Figure 15:
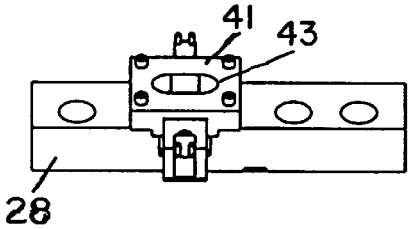
FIG. 15 is a front plan view of the upper half portion of the cylinder head, looking in the direction of arrow 15 of FIG. 1.
Figure 16:
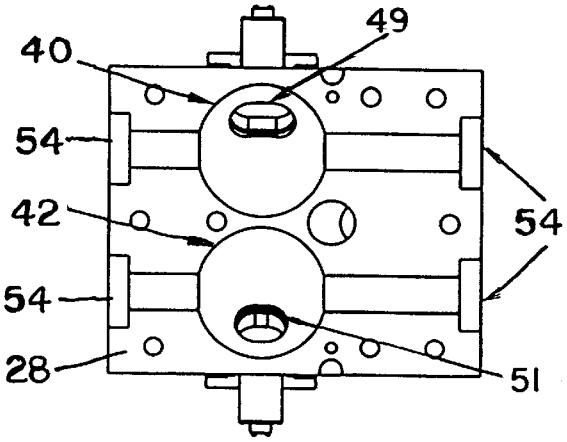
FIG. 16 is a bottom plan view of the upper half portion of the cylinder head.
Figure 19:
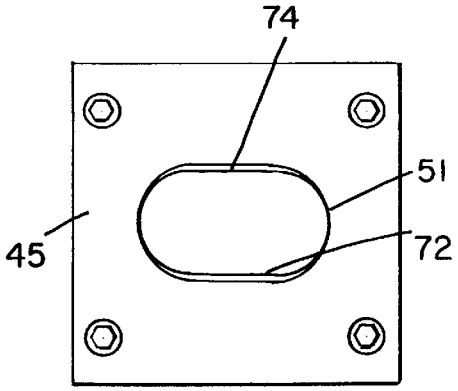
FIGS. 19–22 are views looking from the outside of the intake port, showing various effective gate timing configurations.
Figure 20:
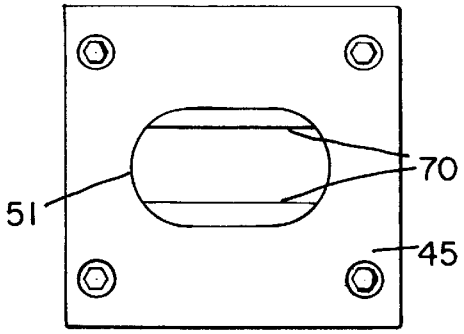
Figure 21:
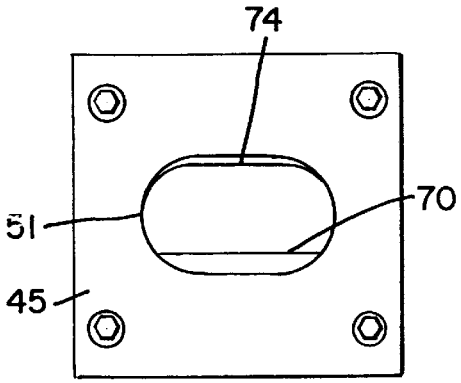
Figure 22:
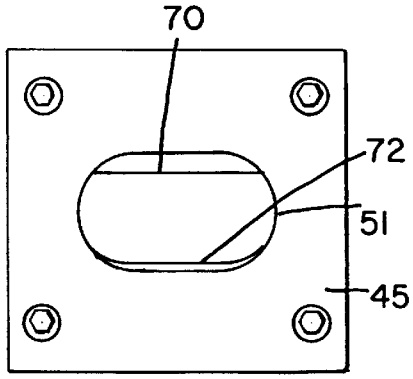

A variable valve timing assembly is generally indicated by the reference numeral 68, and includes gates 70 which are located between each of intake and exhaust ports and the port in its corresponding gate cover, Each gate is preferably made of ceramic or any suitable insulating compound with a small coefficient of linear expansion as well as self lubricating properties. The gates are located in cavities in the upper half portion 28 of the cylinder head and the gate covers 41 and 45. There is suitable clearance between each gate 70 and the stationary housing for allowing the gate to slide through the housing at operating temperature (1500° F.–2000° F.) with no more than four ounces of force requirement to move the gate. There is a gate 70 at each side of the intake port 51 and each side of the exhaust port 49 for movement perpendicular to the fluid flow into) or out each of the ports 51 and 49, thus changing the cross-sectional area of each of the ports 51 and 49 or affecting the effective opening or closing of the intake valve 36 or the exhaust valve 38. FIGS. 19–22 display four different gate configurations used to adjust the effective valve timing from a view looking down on one of the gate covers. FIG. 19 shows the gate cover 45 with both gates 70 retracted so they are not affecting the port where 72 is the leading edge of the valve 36 and 74 is the trailing edge of the valve 36. In this configuration. the gates 70 do not alter the point of when the valve 36 opens or closes. However, it does allow for maximum flow potential, since the cross-sectional area of the port 51 is unobstructed while allowing for valve overlap (when the intake and exhaust valve are open at the same time). The present configuration would be best suited of high engine speeds where charge momentum is strong. FIG. 20 shows the gate cover 45 with both gates 70 protruding so they are affecting the port 51 where the leading edge 72 of the valve 36 and the trailing edge 74 of the valve 36 are blocked by the gates 70 and cannot be seen. In this configuration. the gates 70 alter the point of when the valve 36 opens and closes. Thereby, the effective valve duration is reduced over the previous case, illustrated in FIG. 19. as well as having the minimum flow potential, since the cross-sectional area of the port is obstructed from both sides of the port. The present gate configuration would generally be suited for lower engine speeds when the charge momentum is weak, it may also be beneficial in reducing valve overlap. FIG. 1 may be considered an advanced opening wherein the leading edge 72 which is covered by gate 70 opens early as in the case of FIG. 19. However, the trailing edge 74 of the valve 36 still closes later at the same position as it would in FIG. 20. The present configuration may be beneficial in obtaining a desired valve overlap as the engine speed increase from an idle. FIG. 22 may be considered a retarded opening where the leading edge 72 opens later than it would in FIG. 21. However, the trailing edge 74 of the valve 36 closes at a later position than it would in FIG. 21. The present configuration may also be beneficial in obtaining a desired valve overlap as the engine speed increase from an idle. As state in the summary of the invention gates may be actuated with the use of various mechanical or electro mechanical actuators. Referring to FIG. 6, each gate 70 is controlled by a push/pull solenoid 76 which would generally be controlled by a computer. The solenoids 76 are attached to the upper half of the cylinder head by brackets 78 and 80.

The adjustable rotary valve system of the invention may be advantageously employed in almost any type of internal combustion engine, including diesel engines and direct injected engines. Any such engine realizes better fuel economy by the system of the present invention due to the optimization of the engines compression ratio as well as the optimum combustion for every changing engine condition. Undesirable engine emissions are also greatly reduced by the adjustable valve system especially at low engine speeds. The present invention will also reduce engine noise at low engine speeds inherent to camshaft tappet systems.

What is claimed is:

1. A gas valve apparatus for an internal combustion engine, said gas valve apparatus comprising:

(a) a housing containing a combustion chamber, a first cavity having a first axis, a second cavity having a second axis parallel to said first axis a first inner port connecting said first cavity to said combustion chamber, a first outer port connecting said first cavity to the ambient air, a second inner port connecting said combustion chamber to said second cavity, and a second outer port connecting said second cavity to the ambient air;

(b) a first valve body mounted in said first cavity for rotation about said first axis and containing first a bore which extends transversely of said axis entirely through said first valve body so that said first bore has two openings into said first cavity for connecting said first inner port to said first outer port at two rotational positions of said first valve body:

(c) a second valve body mounted in said second cavity for rotation about said second axis and containing a second bore which extends entirely through said second valve body so that said second bore has two openings into said second cavity for connecting said second inner port to said second outer port at two diametrically opposite rotational positions of said second valve body;

(d) a first gating structure mounted in said housing for movement transversely of said first axis between an inactive position in which said first gate is clear of said first outer port and an active position in which said first gate extends partially into said first outer port, said first gating structure being spaced from said first cavity;

(e) a second gating structure mounted in said housing for movement transversely of said second axis between an inactive position in which said second gate is clear of said second outer port and an active position in which said second gate extends partially into said second outer port, said second gating structure being spaced from said second cavity; and (f) an actuator for selectively moving each of said first and second gates to said inactive positions.

2. A gas valve apparatus for an internal combustion engine, said gas valve apparatus comprising:

(a) a housing containing a combustion chamber, a first cavity having a first axis, a second cavity having a second axis parallel to said first axis, a first inner port connecting said first cavity to said combustion chamber, a first outer port connecting said first cavity to the ambient air, a second inner port connecting said combustion chamber to said second cavity, and a second outer port connecting said second cavity to the ambient air;

(b) a first valve body mounted in said first cavity for rotation about said first axis and containing a bore which extends entirely through said first valve body for connecting said first inner port to said first outer port at two rotational positions of said first valve body;

(c) a second valve body mounted in said second cavity for rotation about said second axis and containing a second bore which extends entirely through said second valve body for connecting said second inner port to said second outer port at two rotational positions of said second valve body;

(d) a first gating structure mounted in said housing for movement transversely of said first axis between an inactive position in which said first gate is clear of said first outer port and an active position in which said first gate extends partially into said first outer port, said first gating structure being spaced from said second cavity, said first gating structure comprising a pair of diametrically opposed first gates, one of said first gates being located at the portion of said first outer port where said first bore enters said first outer port during rotation of said first valve body and the other of said first gates being located at the portion of said first outer port where said first bore loses contact with said first outer port during rotation of said first valve body;

(e) a second gating structure mounted in said housing for movement transversely of said second axis between an inactive position in which said second gate is clear of said second outer port and an active position in which said second gate extends partially into said second outer port, said second gating structure being spaced from said second cavity; and (f) an actuator for selectively moving each of said first and second gates to said inactive positions, said second gating structure comprising a pair of diametrically opposed second gates, one of said second gates being located at the portion of said second outer port where said second bore enters said second outer port during rotation of said second valve body and the other of said second gates being located at the portion of said second outer port where said second bore loses contact with said second outer port during rotation of said second valve body.

3. A gas valve apparatus as recited in claim 2, wherein each of said first and second cavity is spherical and each of said first and second valve bodies is a sphere.

4. A gas valve apparatus as recited in claim 3, wherein said actuator comprises a solenoid operatively to each of said gates for selectively actuating each of said gates independently of the others of said gates.

5. A gas valve apparatus as recited in claim 4, wherein there are a plurality of first and second passages in said housing, each of said plurality of said first and second passages containing one of said seals.

6. A gas valve apparatus for an internal combustion engine, said gas valve apparatus comprising:

(a) a housing containing a combustion chamber, a first cavity having a first axis, a second cavity having a second axis parallel to said first axis, a first inner port connecting said first cavity to said combustion chamber, a first outer port connecting said first cavity to the ambient air, a second inner port connecting said combustion chamber to said second cavity, and a second outer port connecting said second cavity to the ambient air;

(b) a first valve body mounted in said first cavity for rotation about said first axis and containing a bore which extends entirely through said first valve body for connecting said first inner port to said first outer port at two rotational positions of said first valve body;

(c) a second valve body mounted in said second cavity for rotation about said second axis and containing a second bore which extends entirely through said second valve body for connecting said second inner port to said second outer port at two rotational positions of said second valve body;

(d) a first gating structure mounted in said housing for movement transversely of said first axis between an inactive position in which said first gate is clear of said first outer port and an active position in which said first gate extends partially into said first outer port, said first gating structure being spaced from said second cavity, said housing having a first gas passage extending from said combustion chamber to said first cavity in engagement with said first valve body adjacent said first inner port and a second gas passage extending from said combustion chamber to said second cavity in engagement with said second valve body;

(e) a second gating structure mounted in said housing for movement transversely of said second axis between an inactive position in which said second gate is clear of said second outer port and an active position in which said second gate extends partially into said second outer port, said second gating structure being spaced from said second cavity from said;

(f) an actuator for selectively moving each of said first and second gates to said inactive positions;

(g) a first seal located in said first passage at said first cavity; and (h) a second seal located in said second passage at said second cavity each of said seals being adapted to be urged against a respective one of said first and second valve bodies by combustion pressure from said combustion chamber.

* * * * *